United States Patent [19]

Wojcik

[11] Patent Number: 4,656,051

[45] Date of Patent: Apr. 7, 1987

[54] METHOD FOR ELECTROSTATIC COATING THREADED FASTENERS WITH A THERMOPLASTIC RESIN

[76] Inventor: Paul E. Wojcik, 201 W. Highland Rd., Northfield, Ohio 44067

[21] Appl. No.: 776,422

[22] Filed: Sep. 16, 1985

[51] Int. Cl.[4] ..... B05D 1/06

[52] U.S. Cl. ..... 427/33; 427/27; 427/29; 118/630; 118/631; 118/632; 118/633; 118/634

[58] Field of Search ..... 427/27, 33, 29; 118/630, 631, 632, 633, 634

[56] References Cited

U.S. PATENT DOCUMENTS

| | | | |
|---|---|---|---|
| 3,323,934 | 6/1967 | Point | 118/630 |
| 4,245,551 | 1/1981 | Berkman | 118/634 |

*Primary Examiner*—Richard Bueker
*Attorney, Agent, or Firm*—Sand & Hudak Co.

[57] ABSTRACT

A method for electrostatically applying a thermoplastic resin coating on a threaded portion of a fastener to provide a self locking element thereon. A plurality of fasteners are moved by a spaced pair of endless belts passed a spray station where a stream of powdered resin is directed toward the threaded ends of the fasteners. The fasteners and resin are polarized to opposite polarities at the spray station whereby the powdered resin is attracted to and clings to the threaded ends of the fastener and extends completely about the circumference of said ends. Air jet nozzles located downstream of the spray station may direct streams of compressed air against certain portions of the powdered resin to remove the resin therefrom to provide uncoated lead threads and to regulate the distance that the resin extends circumferentially about the threaded ends to provide a coating extending between 180 degrees and 360 degrees about the threaded ends. The powder coated fasteners then pass through a heating zone which melts the powdered resin on the threaded ends forming a permanent bond therebetween and providing the self locking element thereon. The fastener also may be heated before the stream of polarized powdered resin particles is directed toward the fastener to assist in bonding the resin to the fastener and to enable a greater buildup of thermoplastic resin to be applied thereto.

18 Claims, 10 Drawing Figures

METHOD FOR ELECTROSTATIC COATING THREADED FASTENERS WITH A THERMOPLASTIC RESIN

TECHNICAL FIELD

The invention relates to self locking fasteners having a coating of a thermoplastic resin material applied thereto and particularly to a method of applying resin to the fastener. More particularly, the invention relates to an improved method of applying the resin coating electrostatically throughout a predetermined circumferential portion of the fasteners preferably between 180 degrees and 360 degrees.

BACKGROUND ART

The use of self locking fasteners has increased considerably in recent years for a variety of fastening applications wherein the integrity of the fastened members is critical. One common form of providing a self locking fastener is by the use of a thermoplastic resin coating which is applied to portions of the threaded bolt end or internal threads of a nut. Various methods have been developed for applying the thermoplastic material to the threaded area of the fastener. One type of method uses a patch of a soft pliable thermoplastic material which is pressed or melted into the threaded area. Some examples of this method and resulting fastener are shown in U.S. Pat. Nos. 3,093,177; 3,263,726; 3,294,139; 3,313,017; 3,416,492; 3,437,541; 3,552,467; 3,568,746; and 3,634,577. Another common method is to heat the bolt and then direct a spray of powdered resin against the heated bolt whereby the resin will melt and adhere to the threaded areas of the bolt. Examples of such coating methods are shown in U.S. Pat. Nos. 3,766,584; 3,731,724; 3,579,684; 3,787,222 and 4,120,993. In another method, the fastener has a wetting agent applied over a predetermined area and the powdered thermoplastic resin applied to the wetted area after which the fastener is heated to bond the resin to the bolt.

Although many of these known methods provide a satisfactory procedure for applying the thermoplastic resin material to the bolt, one of the disadvantages is that it is difficult to regulate the size of the circumferential area covered by the resin in a simple and inexpensive manner, and in particular to form a resin coated fastener wherein the coating is applied over a circumferential area of between 180 and 360 degrees instead of the 180 degrees area provided by as most known spraying operations. The application of the resin by spraying of the powdered material is believed to be the most economical and satisfactory but does not provide for the satisfactory coating of a circumferential area of the bolt greater than 180 degrees.

U.S. Pat. No. 4,428,981 shows a method for applying a resin coating covering approximately 360 degrees about a bolt by spinning the bolt as it passes through the coating or spray area. Although this method provides a bolt having a resin coating of more than 180 degrees, it requires a dual drive mechanism for spinning the bolts. An alternative means of coating the bolt throughout a full 360 degrees is by the use of a pair of spray nozzles, one on each side of the moving bolt to attempt to provide the 360 degree coating.

Another problem when applying a resin coating to a threaded fastener is that it is difficult to achieve a relatively thick coating of the resin on the fastener without the use of multiple spray nozzles since it is difficult to achieve a sufficient buildup of the resin particles with only a single nozzle.

Therefore, the need has existed for an improved method for coating fasteners and in particular bolts, with a self locking thermoplastic resin in which the coating can be applied throughout a predetermined circumferential area of between 180 degrees and 360 degrees of the threaded area in an extremely simple, efficient and economical procedure.

DISCLOSURE OF THE INVENTION

Objectives of the invention include providing an improved method for coating fasteners with a self locking thermoplastic resin by electrostatically applying the resin to the fasteners by spraying the fasteners as they move past a spray station with a powdered resin electrically charged at an opposite polarity to the charge placed on the fasteners whereby the particles are attracted to the fasteners by the electric field surrounding the fasteners. A still further objective of the invention is to provide such an improved method in which the fasteners may be at ambient temperature when the spray of powdered resin particles is directed toward the fasteners whereby certain portions of the electrostatically adhered resin particles may be removed by subsequent air jet nozzles providing a predetermined pattern of resin particles adhered to the fastener prior to the fasteners passing through a heating zone to firmly bond the desired pattern of resin particles to the threaded area.

Still another objective of the invention is to provide such an electrostatic coating procedure in which the fasteners upon entering the spray zone are contacted by a plurality of metal wires or brushes which are connected to ground to form an induced ground, and in which a positive polarity is applied to the powdered resin particles by high voltage electrodes which extend into the path of the particles as they are sprayed through a nozzle by pressurized air. A further objective is to provide such an improved method in which the spray nozzle assembly is formed of a dielectric material except for an outer flared nozzle end, which end is subjected to a lower voltage of the same polarity as the electrodes which are located upstream in the path of the moving powdered material to maintain the polarity on the powder without presenting a problem of flashover with the adjacent metal fasteners which are at the opposite potential.

A further objective of the invention is to provide an improved method in which a vacuum duct is positioned on an opposite side of the fasteners from the resin spray nozzle assembly at the spray station to recover excess powder, and in which air jet nozzles may be located downstream of the resin spray station to remove portions of the adhered powdered resin from certain portions of the fasteners to obtain the desired circumferential coated distance and to dress and clean the ends of the threaded area to provide an uncoated area enabling the fasteners to be started easily with their mating element before encountering the self locking resin coated area. Still another objective is to provide such an improved method in which a specially designed vacuum duct having an air defuser as a part thereof confines the powered resin particles to a generally specific area on the bolt shank instead of completely covering the bolt due to the attraction of the particles to the bolt of opposite polarity. Another objective is to provide such an improved method which provides an extremely simple, inexpensive and highly effective procedure for coating threaded fasteners and in particular bolts, with a predetermined circumferential area of resin material.

Another objective of the invention is to provide such an improved method in which the fasteners may be heated before entering the spray station whereby a relatively thick coating of resin material can be deposited on the heated fasteners without requiring multiple spray nozzles and without reducing the linear speed of the fasteners as they move through the spray station.

These objectives and advantages are obtained by the improved method of the invention, the general nature of which may be stated as a method for electrostatically coating a threaded fastener with a thermoplastic resin extending around a predetermined circumferential threaded portion of fastener including the steps of moving a threaded fastener along a predetermined path having a spray zone and a heating zone; polarizing the fastener at the spray zone; and polarizing a stream of powdered resin to an opposite polarity than the fastener and directing the resin towards a portion of the threaded end of said fastener whereby the polarized resin is attracted to and clings to said threaded portion forming a coating of powdered resin about said threaded end.

BRIEF DESCRIPTION OF THE DRAWINGS

A preferred embodiment of the invention, illustrative of the best mode in which applicants' have contemplated applying the principles, is set forth in the following description and is shown in the drawings and is particularly and distinctly pointed out and set forth in the appended claims.

Similar numerals refer to similar parts throughout the drawings.

BEST MODE FOR CARRYING OUT THE INVENTION

Figure 1:
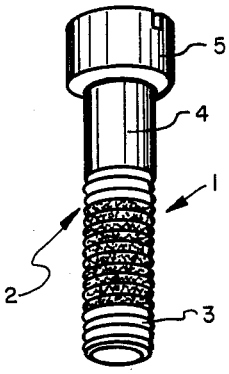
FIG. 1 is a perspective view showing a type of fastener with the thermoplastic resin applied to a predetermined area thereof by the steps of the improved method.

The improved method is described below in relationship to applying a powdered thermoplastic resin coating on a bolt although the improved method could be used for applying similar materials onto other types of threaded fasteners whether having internal or external threads or other arrangements than a threaded area at the end of a shank, and need not be limited to the fastener bolts shown in the drawings and described below.

Figure 2:
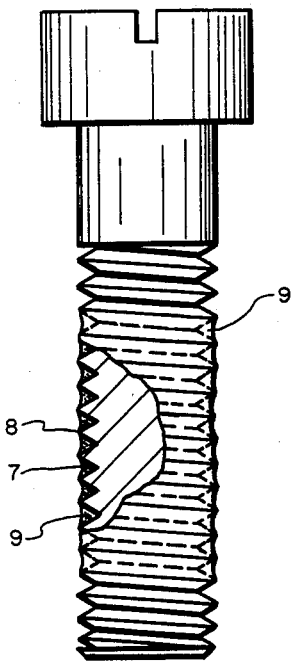
FIG. 2 is an enlarged view with portions broken away and in section showing certain of the threads of the fastener FIG. 1 with the resin applied thereto.
Figure 9:
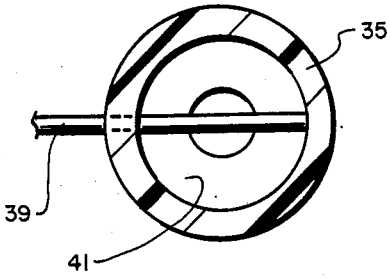
FIG. 9 is an enlarged fragmentary sectional view taken on line 9—9, FIG. 8.

FIG. 1 shows a bolt indicated generally at 1, consisting of a shank 2 having a lower threaded area 3, a smooth upper area 4, and a head 5. The individual threads consist of valleys 7 and peaks 8 as shown in FIG. 2. The resin coating is indicated at 9 and is shown in FIG. 2 being bonded to the bolt and providing a desired uniform coating of valleys 7 preferably not extending above peaks 8.

Figure 3:
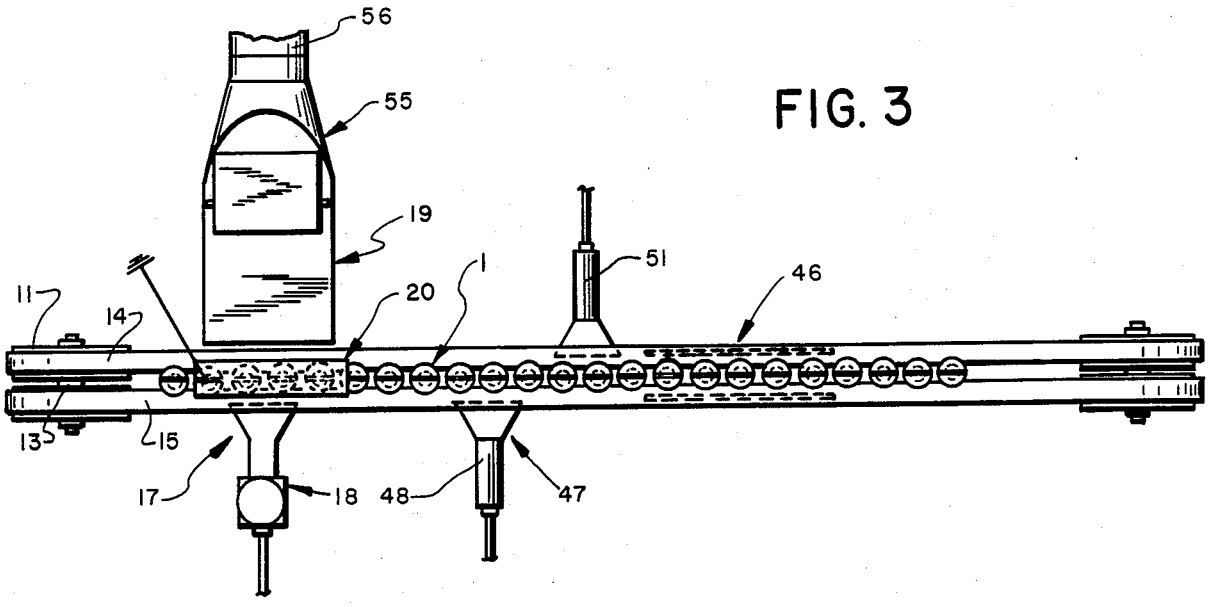
FIG. 3 is a diagrammatic top plan view showing a type of apparatus for carrying out the steps of the improved method.
Figure 4:
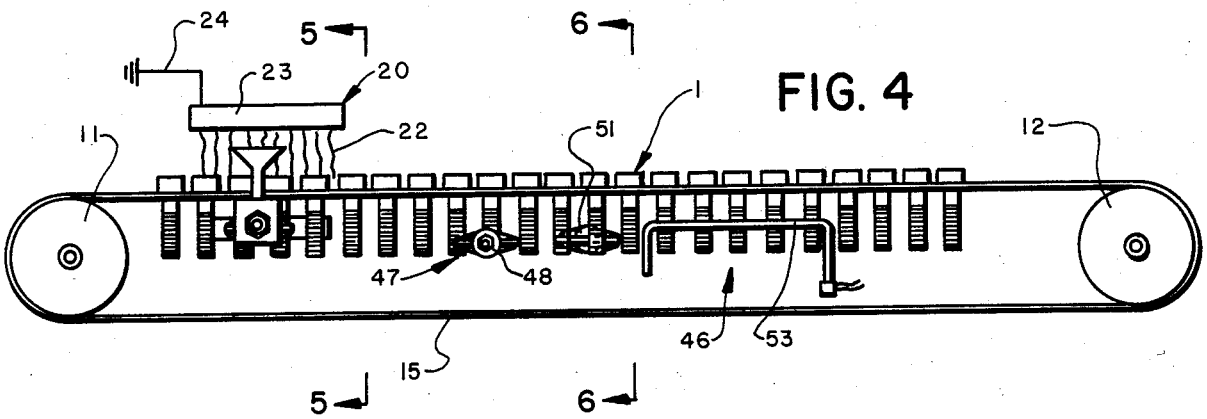
FIG. 4 is a diagrammatic side elevational view of the apparatus shown in FIG. 3.

The apparatus for carrying out the steps of the improved method is shown particularly in FIG. 3 and includes a pair of pulleys 11 and 12 which are power driven preferably by an electric motor and a single shaft (not shown) connected to the pulley shafts 13 whereby the pulleys will rotate at the same speed. Other types of drive mechanisms can be used if desired. Pulleys 11 and 12 are double grooved pulleys in which a pair of endless flexible belts 14 and 15 are located which preferably are formed of nylon or similar flexible inexpensive material. Belts 14 and 15 could also be formed of other types of plastic or dielectric materials.

A spray station, indicated generally at 17, is located generally adjacent pulley 11 and consists principally of a spray nozzle assembly indicated at 18, a vacuum recovery duct 19, and a grounding assembly indicated generally at 20. Grounding assembly 20 consists of a plurality of metallic strands 22 preferably formed of copper to provide good conductivity. Strands 22 extend downwardly from a supporting bar 23 which is connected to ground 24 to form an induced ground. The resiliency and thickness of metallic strands 22 may vary depending upon the particular size and weight of bolts being moved past the spray station by belts 14 and 15 since the larger more rigid strands 22 could affect the movement of the bolts in contrast to a thinner more flexible strand. Other types of grounding strands or brush arrangement can be utilized from that shown in FIG. 3 to provide a grounding affect on the bolts as they pass through the spray station without affecting the concept of the invention.

Figure 7:
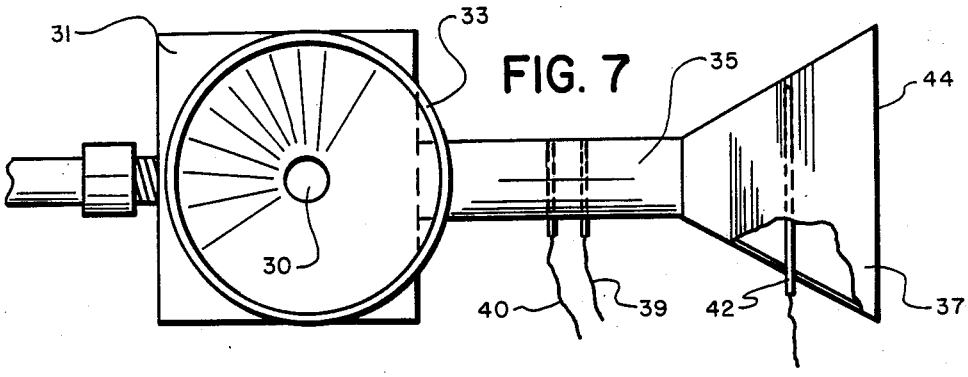
FIG. 7 is a fragmentary diagrammatic top plan view showing a type of spray nozzle for applying the resin to a fastener of the type shown in FIG. 1.
Figure 8:
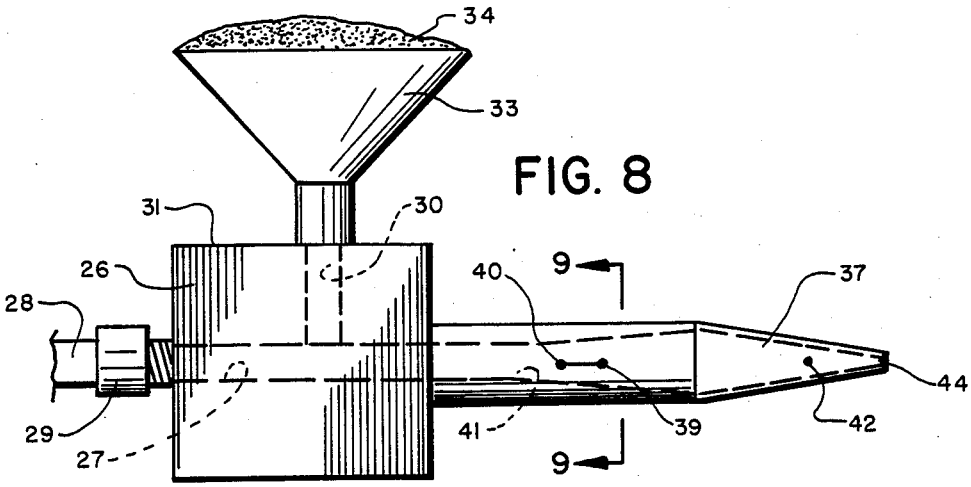
FIG. 8 is a fragmentary diagrammatic side elevational view of the spray nozzle of FIG. 7.

Spray nozzle assembly 18 is shown particularly in FIGS. 7 and 8 and includes a mixing block 26 formed of a dielectric material such as nylon or other type of plastic. A passage 27 extends completely through the nozzle block, one end of which is connected to the end of a hose 28 by a connector 29, with hose 28 being connected to a source of compressed air. A powder inlet opening 30 extends vertically into block 26 from top surface 31 and terminates in passage 27. Preferably passage 27 and inlet opening 30 are of the same uniform diameter size.

A feed funnel or hopper 33 is mounted on upper surface 31 and contains a supply of resin powder 34 which is fed by gravity through opening 30 into passage 27 where the incoming supply of compressed air carries the resin powder through passage 27 and through a nozzle supply sleeve 35 which is connected to block 26 and then to a flared defusing nozzle 37. Sleeve 35 and feed funnel 33 also are formed of a dielectric material with flared nozzle 37 preferably being formed of copper or other metallic material.

In accordance with the invention, high voltage electrodes 39 and 40 extend through supply sleeve 35 and across sleeve bore 41. Bore 41 preferably is tapered outwardly as shown in FIG. 8 to reduce the velocity of the powdered resin being carried by the pressurized air stream along the sleeve upon approaching nozzle 37 for discharge onto bolt 1. This enables sufficient air pressure to be used for carrying the powdered resin material discharged from funnel 33 through sleeve 35 and out of nozzle end 37 without too great a velocity being imparted to the powdered material as it approaches bolt 1. Another electrode 42 preferably is connected to defusing nozzle 37.

Electrodes 39 and 40 preferably are sections of tungsten wire and extend across sleeve bore 41 whereby the particles moving past the electrodes will have a positive D.C. charge applied thereto. In the preferred embodiment, electrodes 39 and 40 will be at a potential of approximately 20 kv positive D.C. voltage with nozzle electrode 42 being at a considerable reduced voltage such as 3 kv. Electrodes 39, 40 and 42 are connected to a usual D.C. transformer (not shown) which is well known in the art.

Figure 10:
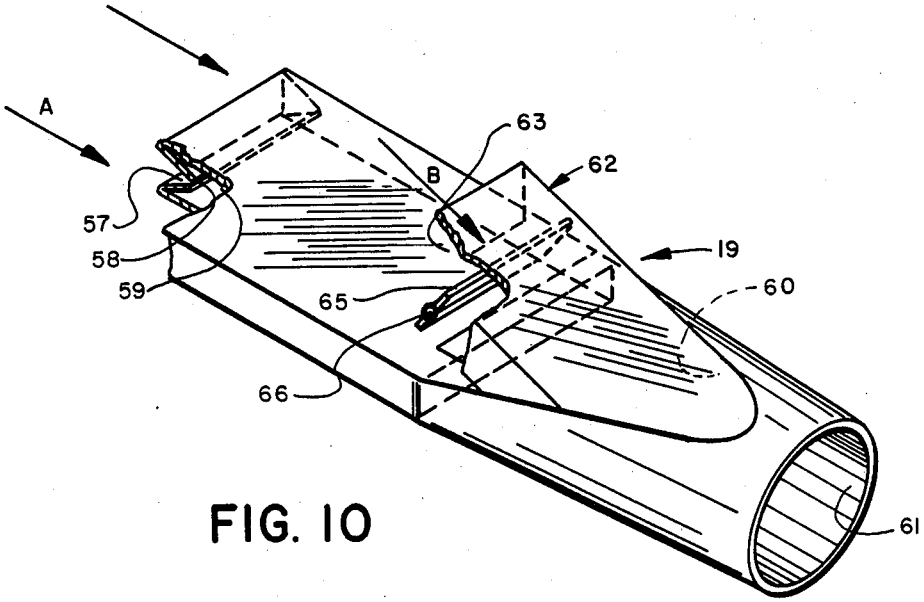
FIG. 10 is a perspective view with portions broken away and in section showing the vacuum duct for recovering spent resin particles.

Vacuum recovery duct 19 preferably is mounted directly opposite nozzle 37 to recover any powdered resin particles which do not adhere to bolt 1. Recovery duct 19 (FIG. 10) includes an air defuser housing indicated generally at 55 which is connected to a source of suction by a hose 56. Housing 55 includes a generally rectangularly shaped front portion and a conical shaped rear portion with the front portion being formed with an inlet end 57 which converges into a narrow elongated opening 58. The air entering inlet opening 58 indicated by arrows A, flows through a hollow rectangular-shaped passageway or chamger 59 and into a tapered area 60 where it flows out of a round outlet 61 and into hose 56. An air defuser mechanism indicated generally at 62 is formed as a part of housing 55 and extends upwardly therefrom having a rectangularly shaped air inlet opening 63 which communicates with conical shaped passage 60. A baffle 65 is pivotally mounted within air defuser 62 and is adjustable by a nob 66 to regulate the amount of air flowing into the air defuser indicated by arrow B.

The particular configuration and construction of vacuum recovery duct 19 enables the excess powder resin particles not attracted to the bolt to be collected and removed from the spray area. More importantly the air stream which it creates moving across the bolt prevents the particles from completely covering the bolt and provides for a general uniform pattern of the resin particles in a specific area of the bolt shank. The use of defuser 62 greatly aids and assists in maintaining the powered resin particles in a defined area on the bolt instead of completely covering the bolt in its entirety with resin particles due to the natural tendency of the particles to adhere to all surfaces of the metal bolt due to the opposite polarities of the bolt and particles and by eliminating turbulence in the moving stream of pressurized air.

Figure 5:
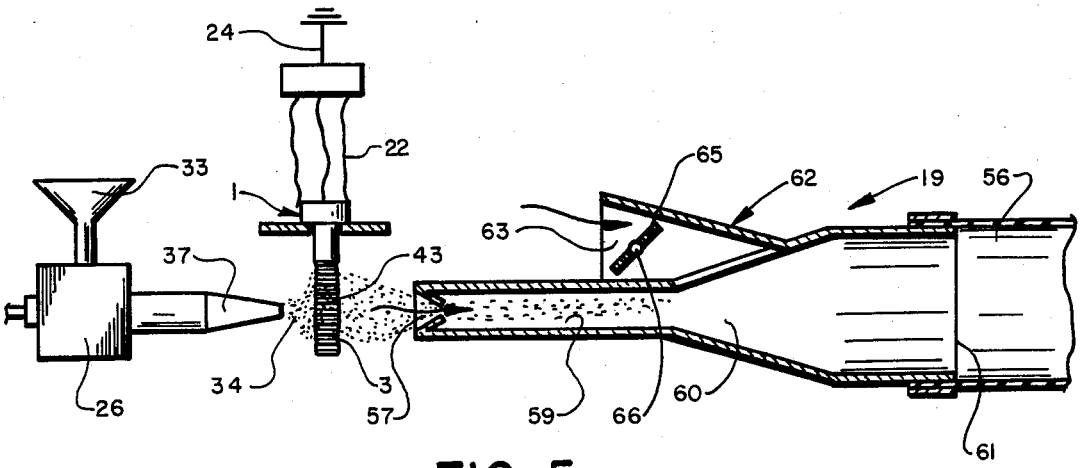
FIG. 5 is an enlarged fragmentary sectional view taken on line 5—5, FIG. 4.

As shown in FIG. 5, the powdered resin particles 34 upon being discharged through nozzle 37 are directed toward a predetermined area of threaded end 3 of bolt shank 2. The electric field established by the opposite polarities of the bolt and resin particles cause the particles to be attracted to the bolt whereby these particles which normally flow past the bolt are captured by the side and rear areas of the bolt to provide the 360 degrees circumferential coverage of the threaded end of the shank. The axial height or length of the powdered coated area 43 is determined by the height of discharge opening 44 of nozzle 37 and vacuum duct 19. Thus in accordance with the concept of the invention, the charging of the resin particles and bolt at opposite polarities enables the heretofore passing particles to adhere to the side and rear portions of the bolt with the front portions being covered by the normally directed contacted particles being sprayed from the nozzle.

The powder particles impinge against the surface of the bolt and in the thread valleys and cling sufficiently to the threads until the bolt passes through a heating zone indicated generally at 46 where the bolt is heated above the fusion point of the resin material whereby the resin melts and bonds to the surfaces of the thread valleys to form the desired thermoplastic coating 9.

Figure 6:
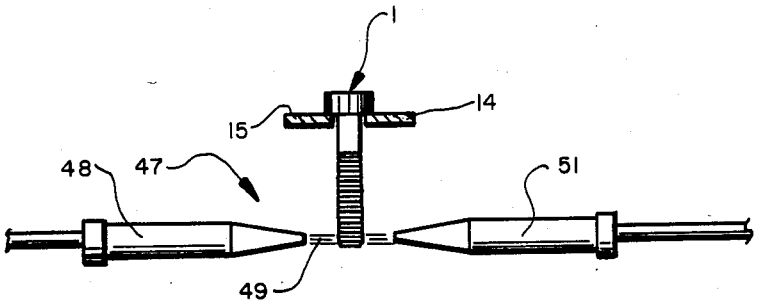
FIG. 6 is an enlarged fragmentary sectional view taken on line 6—6, FIG. 4.

However, before the powder coated bolts reach the heating zone, they are passed through a control zone indicated generally at 47, having one or more air jet nozzles 48. Nozzles 48 direct streams of pressurized air 49 against predetermined areas of the threaded shank to remove certain of the powdered resin particles as shown in FIG. 6 especially at the extended end of the threaded shank. Removal of the powdered resin at the end of shank 2 provides a predetermined uncoated length of lead threads which enables the threads to have a start with a mating nut or threaded hole before the mating threads encounter the resin coated threads.

If desired, other air nozzles 51, only one of which is shown in FIG. 3, may be positioned at control zone 47 or further downstream therefrom and direct against a stream of pressurized air against predetermined portions of the bolt, for example, the back surface thereof, in order to remove the powdered resin from certain areas thereof. Baffles also may be used to direct this pressurized air to the desired areas of the powder coated threads. For example, the powdered resin can be removed from the rear 180 degree surface or portion of the bolt to provide a circumferential powdered coating of between 180 degrees and 360 degrees. If a full 360 degree circumferential coating is desired, air nozzles 51 will not be used. Nozzles 51 provide the means for varying the size of the circumferential resin coating which will be firmly bonded to the threaded area of the bolt at heating zone 46. Since the bolt is at ambient temperature and the resin particles are still in the powdered form, they are removed easily by the jets of air from nozzles 48 and 51 to provide the desired pattern of the ultimate thermoplastic coated area 9.

Heating zone 46 preferably includes an induction heater 53 which raises the temperature of the metal bolt passing therethrough to a point above the fusion or melting point of the thermoplastic powdered material. After the bolt leaves heating zone 46 it is cooled whereby the resin forms a firm bond with the bolt threads. Other types of heaters can be used for heating either the bolt or resin particles for adhering the particles to the bolt than the induction heater shown in the drawings. After the coated bolts leave the heating zone, they are cooled, either by the ambient air or preferably by depositing the bolts into a bath of oil or water, from which they are removed for subsequent storage and/or shipment. The heat of fusion of a type of nylon resin found suitable for coating the threaded bolts ends is approximately 450 to 500 degrees Farenheit.

Although the above described method indicates that the powdered resin particles are sprayed onto the moving fastener before it passes through the heating zone, it may be desirable for certain applications to heat the fastener before it moves through the spray zone. This enables a considerably larger deposit or resin particles to be formed on the fastener and provides a strong bond between the powdered resin and fastener since the resin immediately melts upon contacting the heated fastener with additional resin particles than being attracted to the fastener to provide a thicker coating than believed heretofore possible with known nonelectrostatic coating methods.

The improved method steps of the invention consist broadly of moving one or a plurality of fasteners along a predetermined linear path past a single spray station, at which station the fasteners have a certain polarity. applied thereto and an opposite polarity is imparted to particles of thermoplastic resin which are sprayed toward the fasteners from a nozzle whereby the resin particles which heretofore would pass by the fasteners are attracted to and cling to the sides and rear portions of the fastener shank to provide a powder coating completely about the shank. Next the powder coated fasteners may pass by a control zone in which one or more nozzles remove the powdered particles from selected areas of the fasteners by directing a stream of compressed air toward the selected bolt areas after which the fasteners pass through the heating zone where the powder material is firmly bonded thereto. The fasteners after leaving the heating zone are cooled either by the ambient air or external means at which time the resin material is firmly bonded to the threads to provide the self locking effect desired thereof. If desired, the fasteners are moved through the heating zone before moving through the spray zone.

The above sequence of steps is carried out in a continuous movement of the fasteners by equipment which is extremely simple to operate and relatively inexpensive to manufacture, in contrast to equipment heretofore used for coating fasteners with such a thermoplastic material, and in which the improved method is able to provide a resin coating between 180 degrees and 360 degrees which is difficult to achieve economically by known methods and apparatus. Although the electrostatic coating of metal objects has been performed for years, it has never been applied nor used with the thermoplastic coating of fasteners, and in particular bolts, which enables the powdered resin material to be applied to the bolts when either in a heated or unheated state whereby the powder will adhere completely about the circumference of the bolt enabling the final resin material to be bonded throughout this 360 degree area, if desired, and which permits the easy removal of the powdered resin particles from selected bolt areas by jets of air if applied before the bolt is heated and the resin material fused to the threaded area, thereby enabling a resin coating to be applied to a circumferential threaded area between 180 degrees and 360 degrees in an extremely simple and economic manner.

In production lots the heads of the bolts usually will be closely adjacent or in abutment with each other as they move down the coating line by belts 14 and 15 with one or more bolt shanks being sprayed with the resin powder upon passing spray nozzle 37. Also the polarity applied to the bolts and powdered resin could be reversed from that described above and shown in the drawings. Likewise, other apparatus can be used for applying the opposite polarities to the bolt and resin particles than that shown without affecting the concept of the invention. Preferably, the powdered resin is applied uniformly 360 degrees about the bolt shank to provide a final uniform coating of resin material 9 as shown in FIG. 2. Also, it is readily understood that the bolts will be cleaned with a solvent to remove all grease and oil therefrom before being placed on belts 14 and 15 as is customary in most resin coating procedures.

Accordingly, the improved method is simplified, provides an effective, safe, inexpensive, and efficient procedure which achieves all the enumerated objectives, provides for eliminating difficulties encountered with the prior methods, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved method for electrostatic coating threaded fasteners with a thermoplastic resin is carried out, the characteristics of the improved method, and the advantageous, new and useful results obtained; and the structures, devices, elements, arrangements, parts, and combinations thereof for carrying out the steps of the invention are set forth in the appended claims.

What is claimed is:

1. A method for electrostatic coating a threaded fastener with a thermoplastic resin extending around a predetermined circumferential portion of a threaded portion of the fastener, including the steps of:

(a) moving a threaded fastener along a predetermined path having a spray zone and a heating zone;

(b) polarizing the fastener at the spray zone;

(c) polarizing a stream of powdered resin to an opposite polarity than the fastener and directing the resin towards a threaded portion of said fastener, (d) applying the polarized powdered resin from a single spray station to said threaded portion, (e) forming a coating of powdered resin on the threaded portion about a predetermined circumferential portion of the threaded end extending from 180 degrees to 360 degrees, wherein the threaded fastener is a bolt having a shank and a head, and wherein the bolt is suspended by the head between a spaced pair of endless horizontal moving belts, and (f) moving both of said belts at the same linear speed.

2. The method defined in claim 1 including the step of passing the threaded fastener through the heating zone before moving the fastener through the spray zone.

3. The method defined in claim 1 including the step of passing the powdered resin coated fastener through the heating zone to soften the powdered resin coating causing it to firmly adhere to said threaded end to provide a self-locking resin deposit about a predetermined circumferential portion of each threaded end.

4. The method defined in claim 3 in which the belts extend about a pair of spaced pulleys at least one of which is power driven, and wherein the entire circumferential portion of the threaded end is coated.

5. The method defined in claim 1 in which the heating zone has an induction heating element.

6. The method defined in claim 1 in which the spray zone includes a spray assembly having a mixing block and a delivery tube formed of a dielectric material; in which a spray nozzle is mounted on an extended end of the delivery tube; and in which high voltage electrodes are attached to the delivery tube and extend into the path of the powdered resin which is discharged from the nozzle by pressurized air.

7. The method defined in claim 4 in which the electrodes are connected to a source of D.C. voltage.

8. The method defined in claim 6 in which the nozzle is formed of metal and is connected to a source of D.C. voltage lower than the voltage applied to the electrodes in the delivery tube.

9. The method defined in claim 6 in which the delivery tube is formed with a bore the diameter of which increases towards the spray nozzle.

10. The method defined in claim 1 in which a plurality of flexible metal strips are polarized at a certain polarity and slidably contact the moving fastener at the spray station for polarizing said fastener.

11. The method defined in claim 8 including a grounding assembly having metalic strands, and in which the powdered resin has a positive polarity.

12. The method defined in claim 10 in which the powdered resin is subjected to a 20 K.V. positive D.C. charge.

13. The method defined in claim 1 including the further step of recovering a portion of the powdered resin which does not adhere to the fastener at the spray zone by a vacuum system, said vacuum system including a vacuum duct formed by a hollow housing having a pair of inlet openings which communicate with interior flow chambers which terminate in an outlet opening, one of said inlet openings having a baffle mounted therein to control the flow of air and capture resin particles entering said remaining inlet opening.

14. The method defined in claim 13 including the further step of directing a jet of air against a certain area of the powdered resin coating on the threaded portion of the fastener to remove the powdered resin therefrom before the fastener enters the heating zone.

15. The method defined in claim 14 in which the powdered resin is removed from an outermost portion of the threaded end of the fastener by the air jet to provide uncoated lead threads on the fastener, and wherein the entire circumferential portion of the threaded end is coated.

16. The method defined in claim 11 in which the vacuum system includes a vacuum duct formed by a hollow housing having a pair of inlet openings which communicate with interior flow chambers which terminate in an outlet opening; and in which the outlet opening is adapted to be connected to a vacuum source, and wherein the entire circumferential portion of the threaded end is coated.

17. The method defined in claim 16 in which the housing has a rectangularly shaped front portion and a conical shaped rear portion which terminates in the outlet opening; and in which one of the inlet openings is formed in an end of the rectangularly shaped front portion of the housing with the other of the inlet openings being formed in the conical shaped rear portion of the housing.

18. The method defined in claim 17 in which said other inlet opening is formed by a rectangularly shaped duct having a baffle mounted therein which controls the flow of air and captured resin particles entering said one inlet opening.

* * * * *